US009075422B2

(12) United States Patent
Vemula

(10) Patent No.: US 9,075,422 B2
(45) Date of Patent: Jul. 7, 2015

(54) VOLTAGE REGULATOR CIRCUIT WITH ADAPTIVE CURRENT LIMIT AND METHOD FOR OPERATING THE VOLTAGE REGULATOR CIRCUIT

(75) Inventor: Madan Mohan Reddy Vemula, Tempe, AZ (US)

(73) Assignee: NXP B.V., Eindhoven (NL)

( * ) Notice: Subject to any disclaimer, the term of this patent is extended or adjusted under 35 U.S.C. 154(b) by 233 days.

(21) Appl. No.: 13/485,419

(22) Filed: May 31, 2012

(65) Prior Publication Data

US 2013/0320942 A1 Dec. 5, 2013

(51) Int. Cl.
*G05F 1/10* (2006.01)
*G05F 1/573* (2006.01)

(52) U.S. Cl.
CPC ..... *G05F 1/573* (2013.01)

(58) Field of Classification Search
None
See application file for complete search history.

(56) References Cited

U.S. PATENT DOCUMENTS

| | | | | |
|---|---|---|---|---|
| 4,346,342 | A * | 8/1982 | Carollo | 323/276 |
| 4,851,953 | A * | 7/1989 | O'Neill et al. | 361/101 |
| 5,666,044 | A | 9/1997 | Tuozzolo | |
| 6,137,696 | A * | 10/2000 | Hall et al. | 363/21.05 |
| 7,173,405 | B2 * | 2/2007 | Bo et al. | 323/312 |
| 8,508,199 | B2 * | 8/2013 | Arigliano et al. | 323/277 |
| 8,604,760 | B1 * | 12/2013 | Krishna | 323/273 |
| 2002/0130646 | A1 * | 9/2002 | Zadeh et al. | 323/275 |
| 2004/0100838 | A1 * | 5/2004 | Tamura et al. | 365/200 |
| 2004/0178778 | A1 * | 9/2004 | Bansal | 323/274 |
| 2005/0127976 | A1 * | 6/2005 | Clara et al. | 327/333 |
| 2005/0248326 | A1 * | 11/2005 | Bo et al. | 323/274 |
| 2006/0236141 | A1 | 10/2006 | Chang et al. | |
| 2007/0007934 | A1 * | 1/2007 | Imtiaz | 323/274 |
| 2007/0216383 | A1 | 9/2007 | Al-Shyoukh et al. | |
| 2008/0258688 | A1 | 10/2008 | Hussain et al. | |
| 2011/0121801 | A1 * | 5/2011 | Scaldaferri et al. | 323/276 |

OTHER PUBLICATIONS

Extended European Search Report, EP Application No. 13168854.1, Oct. 31, 2013.

* cited by examiner

*Primary Examiner* — Nguyen Tran
*Assistant Examiner* — Monica Mata

(57) ABSTRACT

A voltage regulator circuit and a method for operating the voltage regulator circuit are described. In one embodiment, a voltage regulator circuit includes an input terminal to receive an input signal from a power interface, an output terminal to output an output signal using the input signal, an output voltage monitor circuit configured to compare the voltage of the output signal with a predetermined voltage threshold, and a current limit circuit configured to limit current flowing on a path from the input terminal to the output terminal to a transient current limit level. The transient current limit level is lower than a predefined current limit threshold of the power interface. Other embodiments are also described.

20 Claims, 4 Drawing Sheets

VOLTAGE REGULATOR CIRCUIT WITH ADAPTIVE CURRENT LIMIT AND METHOD FOR OPERATING THE VOLTAGE REGULATOR CIRCUIT

Embodiments of the invention relate generally to electrical systems and methods for operating the electrical systems and, more particularly, to voltage regulator circuits and methods for operating the voltage regulator circuits.

A power supply interface circuit can provide electrical energy to one or more electronic components. A power supply interface circuit usually includes a power interface and a voltage regulator circuit that receives input supply signals from a power supply and provides regulated output signals within a desired range. However, the power supply can be current limited, which means that a relatively large current extracted from the power supply can cause the voltage level of the power supply to drop. After the power supply is current limited for an extended period of time, the input voltage to the voltage regulator circuit can drop below a certain voltage threshold or be cut off. The voltage regulator circuit can be shut down when the input supply voltage to the voltage regulator circuit drops below the voltage threshold. For example, during the initial charging of the voltage regulator circuit, a large current can be drawn from the power supply, which leads to the power supply voltage to drop significantly and, in turn, causes the voltage regulator circuit to be shut down. In some cases, the input supply signals to the voltage regulator circuit are cut off if the voltage regulator circuit draws more current than the power supply can supply for a period of time. Therefore, there is a need for voltage regulator circuits and methods for operating voltage regulator circuits that deal with the problem of the power supply voltage drop due to the current limit of the power supply.

A voltage regulator circuit and a method for operating the voltage regulator circuit are described. In one embodiment, a voltage regulator circuit includes an input terminal to receive an input signal from a power interface, an output terminal to output an output signal using the input signal, an output voltage monitor circuit configured to compare the voltage of the output signal with a predetermined voltage threshold, and a current limit circuit configured to limit current flowing on a path from the input terminal to the output terminal to a transient current limit level. The transient current limit level is lower than a predefined current limit threshold of the power interface. Other embodiments are also described.

In an embodiment, a portable electronic device includes a power interface and a low dropout (LDO) regulator. The LDO regulator includes an input terminal to receive an input signal from the power interface, an output terminal to output an output signal using the input signal, an output voltage monitor circuit configured to compare the voltage of the output signal with a predetermined voltage threshold, and a current limit circuit configured to limit current flowing on a path from the input terminal to the output terminal to a transient current limit level, where the transient current limit level is lower than a predefined current limit threshold of the power interface.

In an embodiment, a method for operating a voltage regulator circuit involves receiving an input signal from a power interface at an input terminal of the voltage regulator circuit, outputting an output signal using the input signal to an output terminal of the voltage regulator circuit, comparing the voltage of the output signal with a predetermined voltage threshold, and limiting current flowing on a path from the input terminal to the output terminal to a transient current limit level, where the transient current limit level is lower than a predefined current limit threshold of the power interface.

Other aspects and advantages of embodiments of the present invention will become apparent from the following detailed description, taken in conjunction with the accompanying drawings, depicted by way of example of the principles of the invention.

Throughout the description, similar reference numbers may be used to identify similar elements.

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
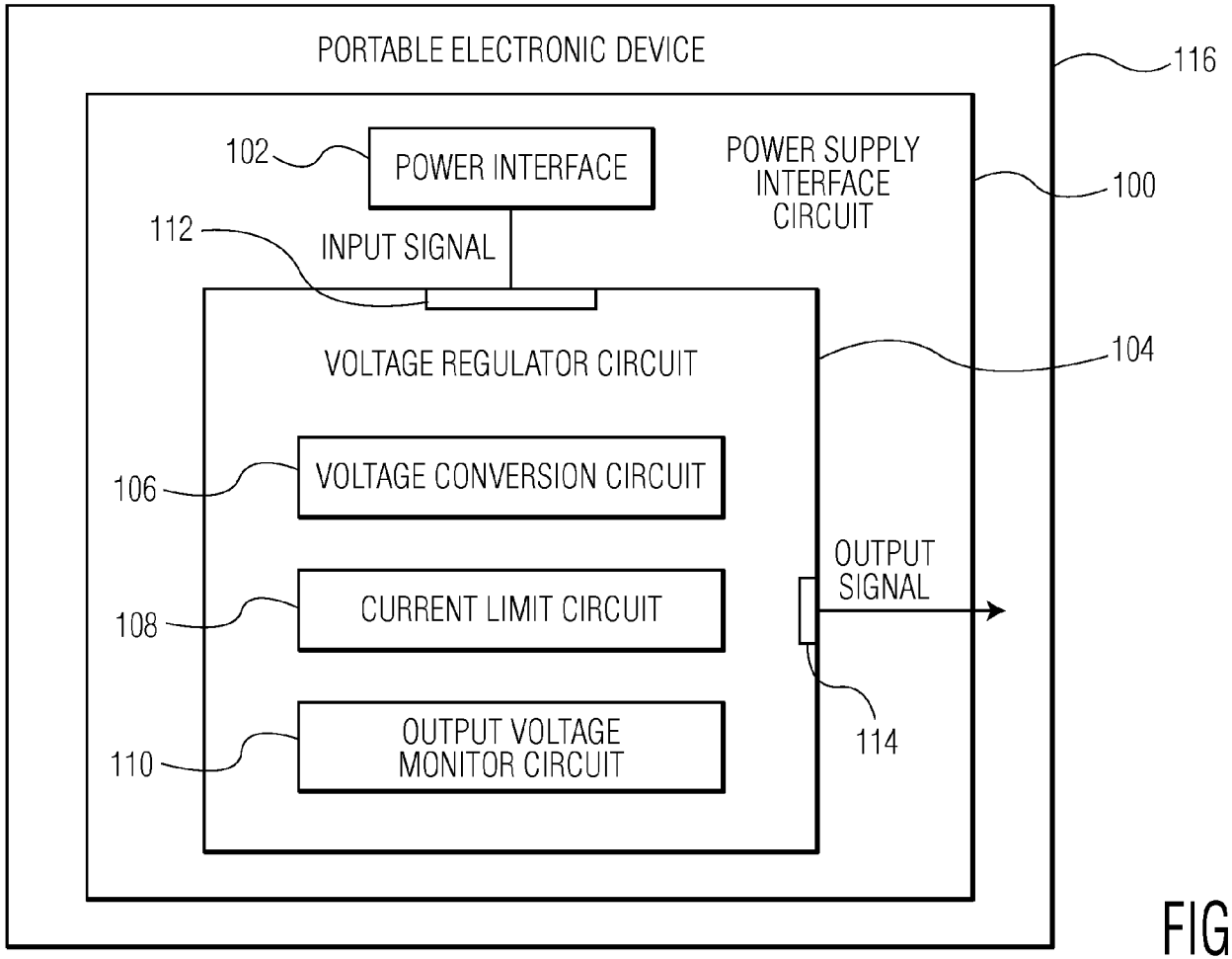
FIG. 1 is a schematic block diagram of a power supply interface circuit in accordance with an embodiment of the invention.

FIG. 1 is a schematic block diagram of a power supply interface circuit 100 in accordance with an embodiment of the invention. The power supply interface circuit may be used for various devices and applications, such as computers, industrial machineries, and household appliances. For example, the power supply interface circuit may be a part of a portable electronic device 116, such as a cellular phone (e.g., a smart phone), a tablet computer, a pad computer, a netbook computer, a laptop computer, a music player, a handheld gaming device, a camcorder, or a camera. In an embodiment, the power supply interface circuit is a part of a camera that is capable to power a peripheral, such as a printer, via a Universal Serial Bus (USB) cable. In some embodiments, at least some components of the power supply interface circuit are implemented in an integrated circuit (IC) chip.

In the embodiment depicted in FIG. 1, the power supply interface circuit 100 includes a power interface 102 and a voltage regulator circuit 104. The power interface is an electrical power supply interface that can supply a certain amount of electrical energy from a power supply (not shown). The power supply may be an electronic device that can supply energy via the power interface. For example, the power supply may be a portable computer with a USB port. In another example, the power supply is a power socket that is connected to the powerline. In an embodiment, the power interface is a USB connection interface, a DisplayPort connection interface or a High-Definition Multimedia Interface (HDMI) connection interface. For example, the power interface is connected to a USB power supply that can charge a battery of the portable electronic device 116.

The voltage regulator circuit 104 is configured to generate an output signal based on an input signal that is received from the power interface 102. In the embodiment depicted in FIG. 1, the voltage regulator circuit 104 includes a voltage conversion circuit 106, a current limit circuit 108, an output voltage monitor circuit 110, an input terminal 112 to receive the input signal from the power interface and an output terminal 114 to output the output signal using the input signal. Although the voltage regulator circuit 104 is depicted and described with certain components and functionality, other embodiments of the voltage regulator circuit 104 may include fewer or more components to implement less or more functionality. In an embodiment, the voltage regulator circuit 104 includes an operational transconductance amplifier (OTA) that compares the output signal with an internal reference voltage and regulates the output signal to a designed value to guarantee output voltage level within +/−5%. The voltage regulator circuit may also include a voltage comparator (not shown) that is used to compare the input voltage (i.e., the voltage of the input signal) with a voltage threshold and to enable or disable the voltage regulator circuit 104 based on the comparison result.

The voltage conversion circuit 106 is configured to transform the input voltage from the power interface 102 into the output voltage of the voltage regulator circuit 104. In an embodiment, the voltage conversion circuit 106 uses a negative feedback technique to maintain a stable voltage for the output signal. Although the voltage conversion circuit 106 and the current limit circuit 108 are depicted in FIG. 1 as being separate circuits, in some embodiments, the voltage conversion circuit 106 and the current limit circuit 108 may share one or more common circuit elements.

The current limit circuit 108 implements an adaptive current limit technique that can prevent the significant drop of the input supply voltage due to the current limit of the power interface 102. In particular, the current limit circuit 108 is configured to limit current flowing on a path from the input terminal 112 to the output terminal 114 to a transient current limit level that is lower than a predefined current limit threshold of the power interface. By setting the current limit in the voltage regulator circuit 104, the current that flows out of the power interface into the voltage regulator circuit 104 can be set to be below (i.e., lower than) the current limit of the power interface. When the power interface operates under the current limit, a relatively stable power supply voltage can be inputted into the voltage regulator circuit 104, which indicates current drawn by the voltage regulator circuit is below the power supply interface power limit. This ensures that the power supply interface circuit is never shut down. For example, a typically USB ON-THE-GO device will shut down the power supply to a peripheral and stop the communication with the peripheral if the peripheral draws a current that is larger than a current threshold set for USB ON-THE-GO peripherals. The current limit circuit 108 can limit the current flowing through the voltage regulator circuit 104 during the power up of the voltage regulator circuit 104 (e.g., during the initial charging of an output capacitor of the voltage regulator circuit 104), during short circuit conditions of the voltage regulator circuit 104 and during normal operations of the voltage regulator circuit 104.

In an embodiment, the current limit circuit 108 sets two levels of current limit for the voltage regulator circuit 104. For example, the current limit circuit 108 can set a first current limit (e.g., 5 milliampere (mA)) and a second current limit (e.g., 10 mA). During the power up of the voltage regulator circuit 104, the first current limit is active by default. Once the output voltage of the voltage regulator circuit 104 reaches a predetermined voltage threshold (e.g., 2 Volt (V)), the second current limit takes over. In an embodiment, the voltage regulator circuit 104 includes a delay circuit, such as a timer, that starts at the same time when the second current limit takes over. The timer is set long enough to ensure that output voltage of the voltage regulator circuit 104 reaches its final value, an output capacitor at the output terminal 114 is completely charged and current from power interface goes into internal or external device. After the timer ends, an internal or external device that is connected to the output terminal is allowed to draw current from the voltage regulator circuit 104. The delay circuit can prevent the internal current limit from being hit before the final voltage is reached and helps charging the output capacitor to the designed voltage at the output terminal during the timer interval.

The output voltage monitor circuit 110 is configured to monitor the output voltage of the voltage regulator circuit 104 and output a monitoring result that can be used by the current limit circuit 108 as one criterion to set the current limit of the voltage regulator circuit 104. Compared to traditional monitoring architectures that sense the output current of a voltage regulator circuit, the output voltage monitor circuit senses the output voltage of the voltage regulator circuit 104 and, therefore, can be made of less expensive components. In an embodiment, the output voltage monitor circuit 110 compares the output voltage with a predetermined voltage threshold and the current limit circuit 108 limits current flowing on the current path from the input terminal 112 to the output terminal 114 to a transient current limit level based on the comparison result. For example, the current limit circuit 108 increases the current limit of the voltage regulator circuit 104 if the output voltage is larger than the predetermined voltage threshold.

Traditional current limit techniques impose a current limit on power supply communication interfaces, such as USB connectors, DisplayPort (DP) connectors and High-Definition Multimedia Interface (HDMI) connectors. DisplayPort is a digital display interface developed by the Video Electronics Standards Association (VESA). HDMI is an interface standard for transferring digital audio/video data. For example, high speed interfaces such as USB and USB ON-THE-GO interfaces impose a current limit that can be drawn from a power supply (e.g., a laptop) without significantly lowering the voltage of the power supply. A USB ON-THE-GO host device can supply a current of 8 mA onto a USB bus at the VBUS pin of the USB connector of the host device. If a peripheral draws more than 8 mA current from the USB bus, the USB ON-THE-GO host device turns off the USB bus and terminates the session. According to the Battery charger specification Rev 1.2 Dec. 2010 of the USB 2.0 host or hub specification, a peripheral cannot draw more than 2.5 mA current if the USB bus is suspended. In another example, a DisplayPort device must limit the transient current during hot-plug by controlling the power-on sequence. In yet another example, when a battery of the portable electronic device 116 is depleted and is in a so called "dead battery mode," the battery voltage is low. For example, the USB specification has a dead battery provision (DBP). When a portable electronic device with a dead battery is attached to a USB charging device that does not include a dedicated charging port such as a wall plug charger, the initial current drawn from the USB charging device is limited to 2.5 mA. After when the portable electronic device communicates with the USB charging device, a larger current can be drawn from the USB charging device. The current drawn from the USB charging device must be smaller than the current limit set for USB interfaces. Otherwise, the input voltage to a voltage regulator will be cut off by a USB host in the USB charging device. All of the above standards impose current limits that circuits can draw from USB, USB ON-THE-GO, DP and HDMI interfaces.

The adaptive current limit technique that is implemented by the current limit circuit 108 can prevent a disruptive shutdown of the voltage regulator circuit 104 due to unwanted voltage dip on the power provided by the power interface 102 and/or too much current being drawn from the power supply via the power interface for a long time interval. For example, when the portable electronic device 116 is in the dead battery mode (i.e., when the battery of the portable electronic device is nearly depleted), the voltage regulator circuit can properly provide power to other components of the portable electronic device to begin the charging of the battery of the portable electronic device without a disruptive shutdown of the voltage regulator circuit. Because disruptive shutdowns of the voltage regulator circuit are avoided, the overall charging time of the portable electronic device can be shortened.

In the embodiment depicted in FIG. 1, the voltage regulator circuit 104 limits the current level based on its output voltage. In an exemplary operation, the current limit circuit 108 sets an initial current limit that is far less than the predefined current limit threshold of the power interface 102. The voltage conversion circuit 106 produces an output voltage at the output terminal 114 and the output voltage monitor circuit 110 monitors the output voltage. When the output voltage at the output terminal reaches a predetermined voltage threshold, the current limit circuit increases the current limit of the voltage regulator circuit 104 to a higher amount, which is set to be lower than the current limit of the power interface, but large enough to satisfy the current requirement of a device that is connected to the voltage regulator circuit 104. The current limit circuit 108 may further increase the current limit of the voltage regulator circuit 104 in response to a further increasing of the output voltage of the voltage regulator circuit 104.

The voltage regulator circuit 104 may be a linear voltage regulator or a non-linear voltage regulator. In an embodiment, the voltage regulator circuit 104 is a low dropout (LDO) regulator. As is known in the art, an LDO regulator is a Direct Current (DC) linear voltage regulator that operates with a relatively small input-output differential voltage. For example, an LDO regulator can operate properly even when the input voltage is less than one volt higher than the regulated output voltage. Compared to a non-LDO regulator, an LDO regulator can have a lower minimum operating voltage, higher efficiency operation and lower heat dissipation and, consequently, can be particularly useful for a battery operated device.

Figure 2:
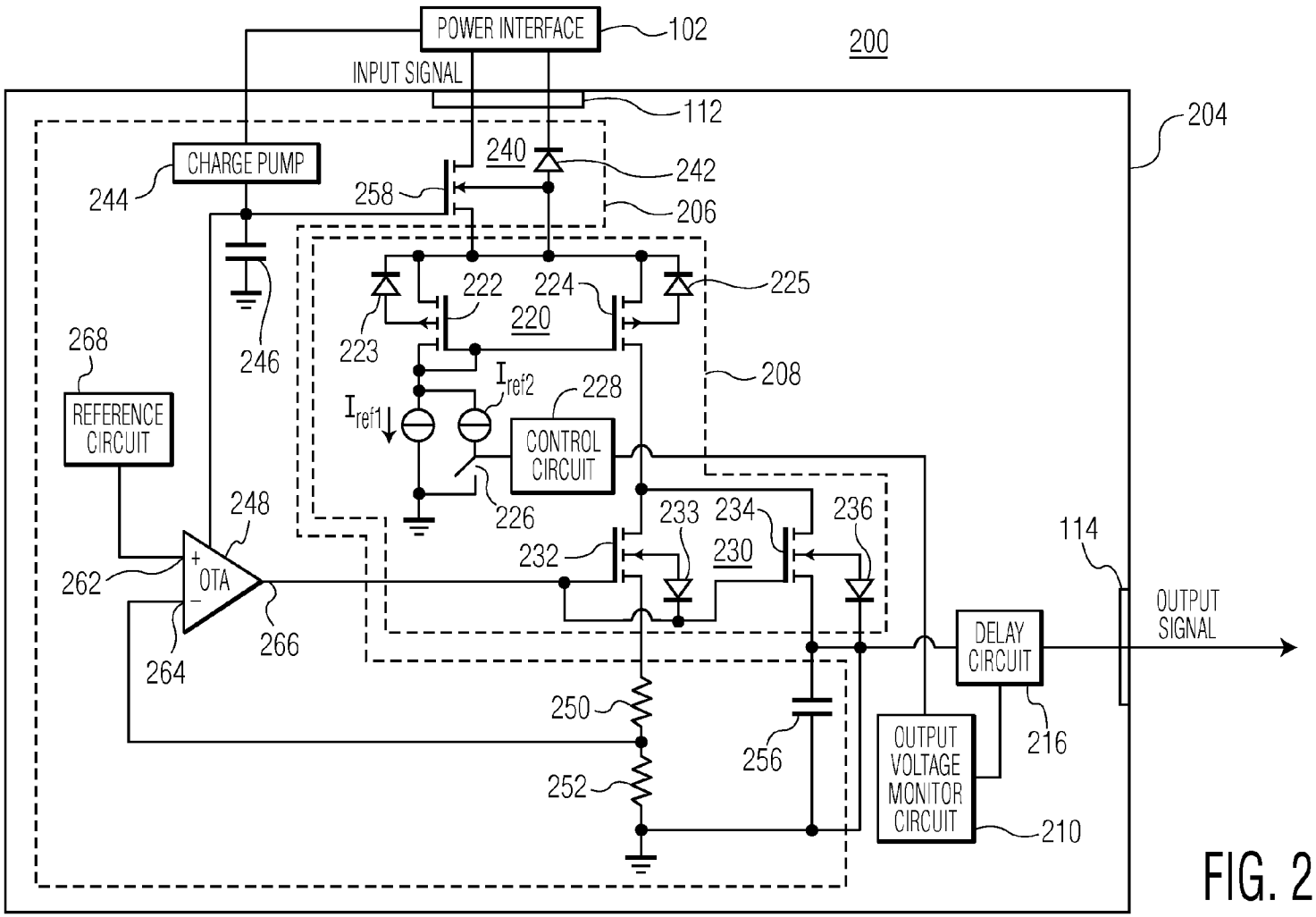
FIG. 2 depicts an embodiment of the power supply interface circuit depicted in FIG. 1 that includes a low dropout (LDO) regulator.

FIG. 2 depicts an embodiment of the power supply interface circuit 100 depicted in FIG. 1 that includes an LDO regulator 204. In the power supply interface circuit 200 depicted in FIG. 2, the LDO regulator is connected to the power interface 102 that has an initial voltage of up to 20V. The LDO regulator includes a voltage conversion circuit 206, a current limit circuit 208, an output voltage monitor circuit 210, an input terminal 112 to receive the input voltage and current from the power interface, an output terminal 114 to output the output voltage and current using the input voltage and current, and an optional delay circuit 216.

The output voltage monitor circuit 210 is configured to monitor the output voltage of the LDO regulator 204 and to compare the output voltage with a predetermined voltage threshold to generate a comparison result. In an embodiment, the output voltage monitor circuit 210 is a power-on-detect circuit. The predetermined voltage threshold can be set to an arbitrary value, such as 2V. The comparison result may be in the form of a logical signal that can be either "0" or "1," depending upon the value relationship between the output voltage and the threshold. For example, when the output voltage of the LDO regulator is larger than the threshold, the logical signal is set to "1."

The current limit circuit 208 is configured to limit current flowing on the current path from the input terminal 112 to the output terminal 114 to a transient current limit level based on the comparison result between the output voltage and the predetermined voltage threshold, which can be decided by the output voltage monitor circuit 210. The initial and final current limit levels are lower than the current limit threshold of the power interface 102. In the embodiment depicted in FIG. 2, the current limit circuit 208 includes a current mirror circuit 220 and a replica bias circuit 230. The current mirror circuit includes two PMOS devices 222, 224, parasitic diodes 223, 225, a first current source "$I_{ref1}$," a second current source "$I_{ref2}$," a switch circuit 226 and a control circuit 228. The replica bias circuit includes two NMOS devices 232, 234 and parasitic diodes 233, 236. The replica bias circuit generates a replica of the output voltage from the voltage conversion circuit 206 onto an output capacitor 256 that is connected between the output terminal 114, from which the output voltage of the LDO regulator 204 is outputted, and the ground. The parasitic diodes 223, 225, 233 and 236, as well as a parasitic diode 242, are shown in FIG. 2 to indicate that there is no current path between the input terminal 112 and the output terminal 114 when the LDO regulator is enabled or disabled.

The current mirror circuit 220 acts as a resistor for smaller currents and acts as a current source at higher currents. The current level of the first current source "$I_{ref2}$" is set to be lower than the normal load current that the LDO regulator 204 can supply and to be much lower than the current limit of the power interface 102. The primary usage of the first current source "$I_{ref1}$" is to charge the output capacitor 256.

The control circuit 228 is configured to enable (i.e., turn on) or disable (i.e., turn off) the switch 226 to connect or disconnect the second current source "$I_{ref2}$" according to the monitoring result from the output voltage monitor circuit 210. In an embodiment, the control circuit controls the switch based on the comparison result between the output voltage of the LDO regulator 204 and the predetermined voltage threshold. For example, by default, the switch is disabled (i.e., turned off). The control circuit enables the switch to connect the second current source "$I_{ref2}$" and increases the reference current for the current mirror circuit 220 when the logical signal of the comparison result is "1," (i.e., when the output voltage of the LDO regulator is larger than the predetermined voltage threshold). In an embodiment, the reference current for the current mirror circuit is doubled if the output voltage of the LDO regulator is larger than the predetermined voltage threshold. In this embodiment, the current level of the second current source "$I_{ref2}$" is the same as the current level of the first current source "$I_{ref1}$." The increasing of the reference current for the current mirror circuit increases the current flowing through the replica bias circuit 230. Because the replica bias circuit is connected to the output terminal 114 of the LDO regulator, the output current that flows out of the output terminal is increased when the reference current for the current mirror circuit is increased. In an embodiment, the current mirror circuit has a transfer ratio that is much larger than one while the replica bias circuit has a transfer ratio that is close to or equal to one. It is possible that the transfer ratios of the current minor circuit and the replica bias circuit are set to the same value or similar values. In an embodiment, the transfer ratio between the reference current and the input current level of the current minor circuit is 1:150. For example, when the reference current is 60 μA, the input current level of the current minor circuit is 9 mA. To avoid the unwanted voltage drop on the power interface 102, the reference current of the current minor circuit is set to a level such that the input current level of the current mirror circuit is lower than the current limit of the power interface.

In traditional LDO regulators, the charging of a large output capacitor (e.g., the capacitor 256) during the power up of the LDO regulators and during short circuit conditions can draw a large amount of current from the power interface 102 and causes the LDO regulators to shut down. In contrast, the LDO regulator 204 uses the current limit circuit 208, the output voltage monitor circuit 210, and the optional delay circuit 216 to gradually increase the current drawn from the power interface according to the output voltage of the LDO regulator and avoids disruptive shutdowns.

The voltage conversion circuit 206 of the LDO regulator 204 includes an extended drain NMOS device 240, the parasitic diode 242, a charge pump 244, an input capacitor 246, an operational transconductance amplifier (OTA) 248, three resistors 250, 252 and the output capacitor 256. The extended drain NMOS device acts as a voltage adapter that transforms the input voltage (e.g., 20V) from the power interface 102 into the input voltage (e.g., 5V) of the current mirror circuit 220. The parasitic diode 242 is connected in parallel with the extended drain NMOS device and acts as an overload protection circuit.

The charge pump 244 is connected to the power interface 102, the input capacitor 246, the gate terminal 258 of the extended drain NMOS device 240 and the OTA 248. The charge pump is configured to convert the input voltage from the power interface into an intermediate voltage, which is applied to the gate terminal 258 of the extended drain NMOS device, the input capacitor, and the OTA. In an embodiment, the intermediate voltage is 5.4V. The input capacitor helps to reduce ripples of the intermediate voltage. In an embodiment, the input capacitor has a capacitance value of 20 pF.

The OTA 248 is powered by the charge pump 244. In the embodiment depicted in FIG. 2, the OTA and the resistors 250, 252 form a feedback loop. In particular, a first input terminal (positive terminal) 262 of the OTA is connected to a reference voltage (e.g., a bandgap voltage), a second input terminal (negative terminal) 264 of the OTA is connected to the resistors 250, 252, and the output terminal 266 of the OTA is connected to the resistor 250 through the replica bias circuit 230. In the embodiment depicted in FIG. 2, the reference voltage is generated by a reference circuit 268. In an embodiment, the reference voltage has a voltage of 1.25V. The resistors and the output capacitor 256 are connected to the ground. The output capacitor is connected to the output terminal of the LDO regulator and is used to reduce ripples of the output voltage at the output terminal 114. The output capacitor typically has a relatively large capacitance value (e.g., 1 to 3 microfarad (uF)).

In the embodiment depicted in FIG. 2, the LDO regulator 204 further includes the delay circuit 216 that is configured to delay the outputting of the output current of the voltage regulator circuit to a circuit that is connected to the LDO regulator. In an embodiment, the delay circuit, such as a timer, begins to operate after the switch 226 is turned on and the second current source "$I_{ref2}$" is connected. The timer is set long enough to ensure that the output voltage of the LDO regulator 204 reaches its final value. After the timer ends, an internal or external device that is connected to the output terminal 114 is allowed to draw current from the voltage regulator circuit 104. The delay circuit can prevent the internal current limit from being hit before the final voltage is reached and helps charging the output capacitor 256 to the designed voltage at the output terminal during the timer interval. For example, to prevent the power interface 102 from providing electric currents to both the output capacitor 256 and to a device connected to the output terminal 114 of the LDO regulator, the delay circuit may be a digital timer that starts and counts a fixed time period of delay before actually enabling the internal or external circuit connected to the voltage output terminal 114, after the output voltage of the voltage regulator circuit reaches a predetermined voltage threshold. This fixed time period of delay is calculated from the maximum internal current, the capacitance value of the output capacitor 256, a voltage threshold of the output voltage monitor circuit and the output voltage of the LDO regulator. In an embodiment, the delay is set to around 1 millisecond (ms).

In an exemplary startup operation of the LDO regulator 204, the charge pump 244 converts the input voltage from the power interface 102 into an intermediate voltage, which activates the extended drain NMOS device, charges the input capacitor 246 and supplies power to the OTA 248. The extended drain NMOS device 240 transforms the power supply voltage into the input voltage of the current mirror circuit 220 and the current mirror circuit 220 begins its operation. By default, the switch 226 is turned off and the current mirror circuit operates on the first current source "$I_{ref1}$," which, in turn, limits the current that is drawn from the power interface. The activated OTA enables the replica bias circuit 230, which, in turns, charges the output capacitor 256 based on the current level of the first current source "$I_{ref1}$." When the output voltage of the LDO regulator, which is monitored by the output voltage monitor circuit 210, increases to a level that is larger than a predetermined voltage threshold, the control circuit 228 increases the reference current for the current mirror circuit by turning on the switch 226 to connect the second current source "$I_{ref2}$." The addition of the second current source "$I_{ref2}$" increase the current that is drawn from the power supply to a level that is still lower than a current limit threshold of the power interface 102 beyond which the power supply voltage decreases significantly or is completely cut off. To prevent a circuit that is connected to the LDO regulator from drawing current before the LDO regulator reaches the final voltage, the delay circuit 216 counts a fixed time period of delay before actually enabling the circuit after the output voltage of the voltage regulator circuit reaches the predetermined voltage threshold.

Although the LDO regulator 204 is depicted and described with certain components and functionality, other embodiments of the LDO regulator may include fewer or more components to implement less or more functionality. In one embodiment, at least one of the extended drain NMOS device 240, the charge pump 244 and the reference circuit 268 is a separate device that is located external to the LDO regulator. In addition, although the control circuit 228 is described as a part of the current limit circuit 208, in some embodiments, the control circuit is integrated into the output voltage monitor circuit 210. Furthermore, in other embodiments, different types of transistors may be used for the MOS devices.

Figure 3:
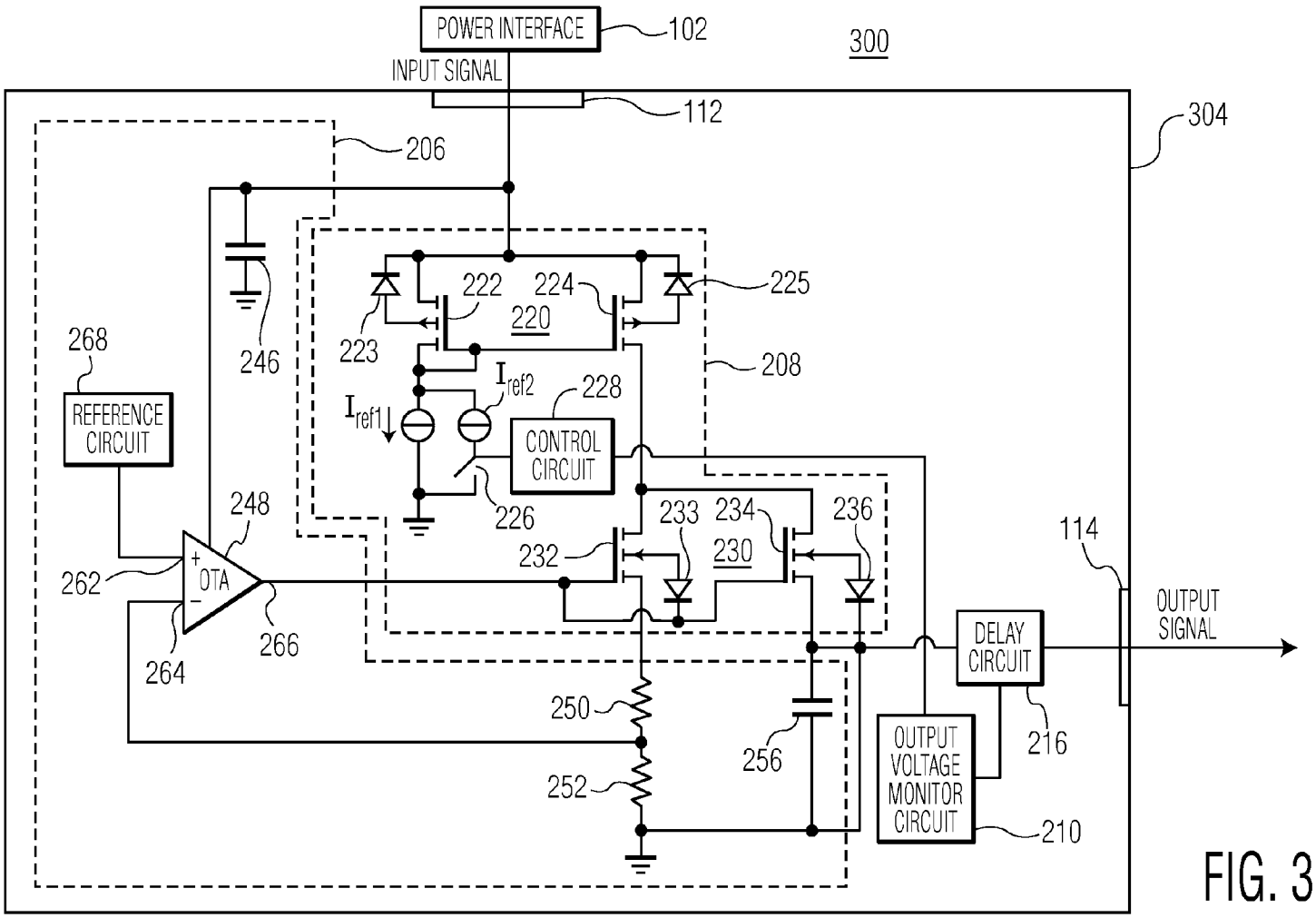
FIG. 3 depicts another embodiment of the power supply interface circuit depicted in FIG. 1 that includes an LDO regulator.

The extended drain NMOS device 240 is used to handle input signal having a relatively high supply voltage, such as 16V to 20V. When the supply voltage is close to the regulated output voltage, the extended drain NMOS device 240 is no longer needed. FIG. 3 depicts another embodiment of the power supply interface circuit 100 depicted in FIG. 1 that includes an LDO regulator 304. The difference between the LDO regulator 304 of the power supply interface circuit 300 and the LDO regulator 204 of the power supply interface circuit 200 is that LDO regulator 304 does not include the extended drain NMOS device 240 and the charge pump 244. In particular, in the embodiment depicted in FIG. 3, the input signal from the power interface 102 is inputted into the current mirror circuit 220 without passing through the extended drain NMOS device. Although the charge pump is not included in the LDO regulator 304 as shown in FIG. 3, in some embodiment, the LDO regulator 304 may include the charge pump.

Figure 4:
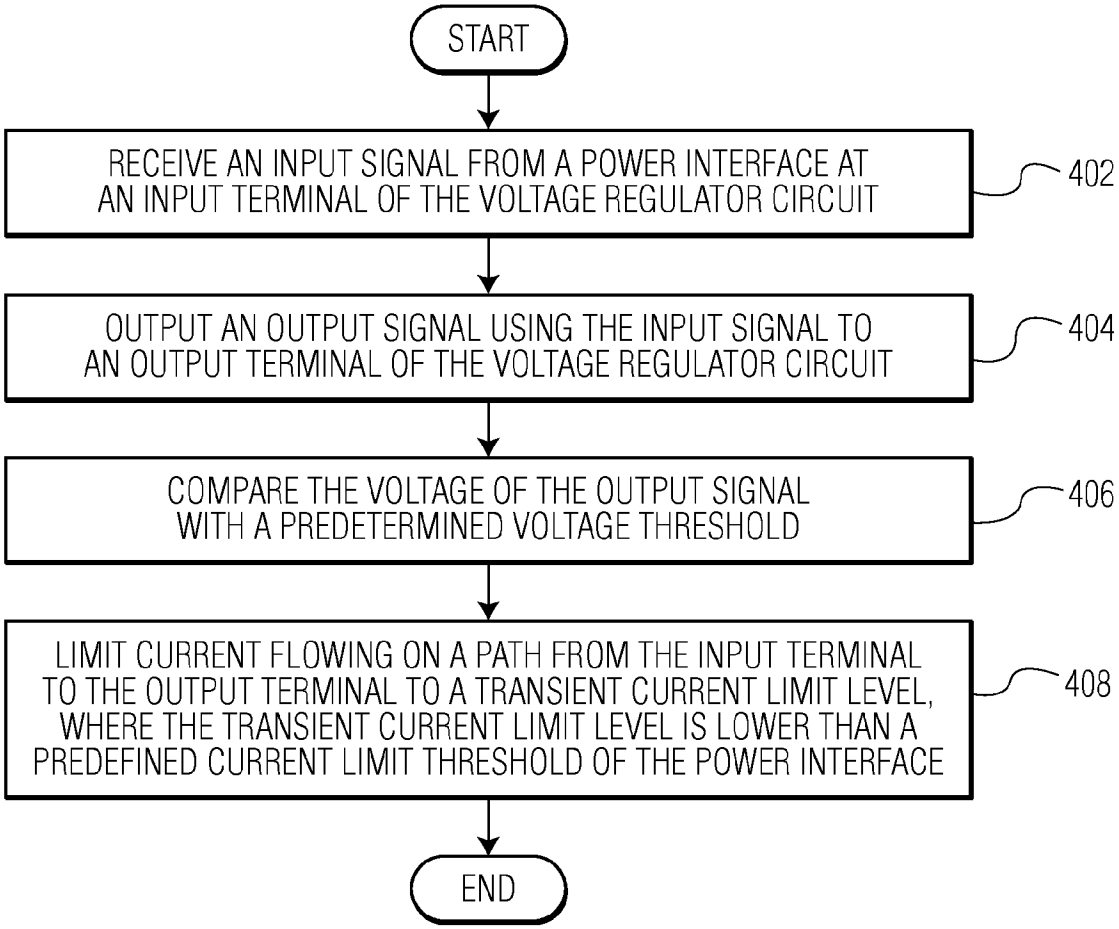
FIG. 4 is a process flow diagram of a method for operating a voltage regulator circuit in accordance with an embodiment of the invention.

FIG. 4 is a process flow diagram of a method for operating a voltage regulator circuit in accordance with an embodiment of the invention. The voltage regulator circuit may be similar to or the same as the voltage regulator circuits 100, 200, 300 depicted in FIGS. 1 and 2. At block 402, an input signal is received from a power interface at an input terminal of the voltage regulator circuit. At block 404, an output signal is outputted using the input signal to an output terminal of the voltage regulator circuit. At block 406, the voltage of the output signal is compared with a predetermined voltage threshold. At block 408, current flowing on a path from the input terminal to the output terminal is limited to a transient current limit level, where the transient current limit level is lower than a predefined current limit threshold of the power interface.

Although the operations of the method herein are shown and described in a particular order, the order of the operations of the method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

In addition, although specific embodiments of the invention that have been described or depicted include several components described or depicted herein, other embodiments of the invention may include fewer or more components to implement less or more feature.

Furthermore, although specific embodiments of the invention have been described and depicted, the invention is not to be limited to the specific forms or arrangements of parts so described and depicted. The scope of the invention is to be defined by the claims appended hereto and their equivalents.

What is claimed is:

1. A voltage regulator circuit comprising:

an input terminal to receive an input signal from a power interface;

an output terminal to output an output signal using the input signal;

an output voltage monitor circuit configured to compare an output voltage of the output signal with a predetermined voltage threshold; and a current limit circuit configured to limit current flowing on a path from the input terminal to the output terminal to a transient current limit level, wherein the transient current limit level is lower than a predefined current limit threshold of the power interface, wherein the current limit circuit is further configured to increase the transient current limit level if the output voltage is higher than the predetermined voltage threshold, and wherein the current limit circuit includes a first current source that is enabled during the startup of the voltage regulator circuit and a second current source that is enabled after the output voltage is higher than the predetermined voltage threshold, wherein the current limit circuit comprises a replica bias circuit configured to generate a replica of a voltage transformed from the input signal onto an output capacitor connected to the output terminal and a current mirror circuit that is connected between the input terminal and the output terminal, and wherein the current mirror circuit includes two transistor devices, the first and second current sources, a switch circuit connected in series with the second current source and a control circuit configured to enable or disable the switch circuit to connect or disconnect the second current source.

2. The voltage regulator circuit of claim 1, wherein the current limit circuit is further configured to set the transient current limit level to a default value during the startup of the voltage regulator circuit and to increase the transient current limit level after the output voltage is higher than the predetermined voltage threshold to avoid voltage dip of the input signal and prevent shutdown of the voltage regulator circuit or the power interface.

3. The voltage regulator circuit of claim 1 further comprising a delay circuit configured to delay the output of the current of the output signal after the output signal is generated and the output voltage is higher than the predetermined voltage threshold to provide current to an external load from the power interface.

4. The voltage regulator circuit of claim 1, wherein the current limit circuit includes a current mirror circuit that is connected between the input terminal and the output terminal.

5. The voltage regulator circuit of claim 4, wherein the current limit circuit further includes a drain extended metal oxide semiconductor device connected between the input terminal and the current minor circuit.

6. The voltage regulator circuit of claim 1, wherein the voltage regulator circuit is a low dropout (LDO) regulator.

7. The voltage regulator circuit of claim 1, wherein the power interface is a current limited interface that comprises a Universal Serial Bus (USB) interface, a USB ON-THE-GO interface, a DisplayPort interface or a High-Definition Multimedia Interface (HDMI) interface.

8. A portable electronic device comprises:

a power interface; and a low dropout (LDO) regulator comprising:

an input terminal to receive an input signal from the power interface;

an output terminal to output an output signal using the input signal;

an output voltage monitor circuit configured to compare an output voltage of the output signal with a predetermined voltage threshold; and a current limit circuit configured to limit current flowing on a path from the input terminal to the output terminal to a transient current limit level, wherein the transient current limit level is lower than a predefined current limit threshold of the power interface, wherein the current limit circuit is further configured to increase the transient current limit level if the output voltage is higher than the predetermined voltage threshold, and wherein the current limit circuit includes a first current source that is enabled during the startup of the voltage regulator circuit and a second current source that is enabled after the output voltage is higher than the predetermined voltage threshold, wherein the current limit circuit comprises a replica bias circuit configured to generate a replica of a voltage transformed from the input signal onto an output capacitor connected to the output terminal and a current mirror circuit that is connected between the input terminal and the output terminal, and wherein the current mirror circuit includes two transistor devices, the first and second current sources, a switch circuit connected in series with the second current source and a control circuit configured to enable or disable the switch circuit to connect or disconnect the second current source.

9. The portable electronic device of claim 8, wherein the current limit circuit is further configured to set the transient current limit level to a default value during the startup of the voltage regulator circuit and to increase the transient current limit level after the output voltage is higher than the predetermined voltage threshold to avoid voltage dip of the input signal and prevent shutdown of the voltage regulator circuit or the power interface, wherein the portable electronic device further includes a battery that is connected to the LDO regulator, and wherein the battery is charged in response to the output signal when the battery is depleted.

10. The portable electronic device of claim 8 further comprising a delay circuit configured to delay the output of the current of the output signal after the output signal is generated and the output voltage is higher than the predetermined voltage threshold to help charging an output capacitor to a designed voltage at the output terminal during a timer interval.

11. The portable electronic device of claim 8, wherein the current limit circuit includes a current mirror circuit that is connected between the input terminal and the output terminal.

12. The portable electronic device of claim 8, wherein the power interface is a current limited interface that comprises a Universal Serial Bus (USB) interface, a USB ON-THE-GO interface, a DisplayPort interface or a High-Definition Multimedia Interface (HDMI) interface.

13. A method for operating a voltage regulator circuit, the method comprising:

receiving an input signal from a power interface at an input terminal of the voltage regulator circuit;

outputting an output signal using the input signal from an output terminal of the voltage regulator circuit;

comparing an output voltage of the output signal with a predetermined voltage threshold; and limiting current flowing on a path from the input terminal to the output terminal to a transient current limit level, wherein the transient current limit level is lower than a predefined current limit threshold of the power interface, wherein limiting the current flowing on the path from the input terminal to the output terminal to the transient current limit level comprises increasing the transient current limit level if the output voltage is higher than the predetermined voltage threshold, wherein limiting the current flowing on the path from the input terminal to the output terminal to the transient current limit level comprises enabling a first current source during the startup of the voltage regulator circuit and enabling a second current source after the output voltage is higher than the predetermined voltage threshold, wherein limiting the current flowing on the path from the input terminal to the output terminal to the transient current limit level comprises generating a replica of a voltage transformed from the input signal onto an output capacitor connected to the output terminal and enabling or disabling a switch circuit connected in series with the second current source to connect or disconnect the second current source.

14. The method of claim 13, wherein limiting the current flowing on the path from the input terminal to the output terminal to the transient current limit level comprises:

setting the transient current limit level to a default value during the startup of the voltage regulator circuit; and increasing the transient current limit level after the output voltage is higher than the predetermined voltage threshold to avoid voltage dip of the input signal and prevent shutdown of the voltage regulator circuit or the power interface.

15. The method of claim 13, wherein the voltage regulator circuit is integrated in a portable electronic device that includes a battery, wherein the method further includes charging the battery in response to the output signal.

16. The voltage regulator circuit of claim 1, wherein the second current source is enabled only after the output voltage is higher than the predetermined voltage threshold.

17. The portable electronic device of claim 8, wherein the second current source is enabled only after the output voltage is higher than the predetermined voltage threshold.

18. The method of claim 13, wherein limiting the current flowing on the path from the input terminal to the output terminal to the transient current limit level comprises enabling the second current source only after the output voltage is higher than the predetermined voltage threshold.

19. The voltage regulator circuit of claim 1, wherein the two transistor devices of the current mirror circuit include two PMOS devices.

20. The voltage regulator circuit of claim 19, wherein gate terminals of the two PMOS devices are connected together.

* * * * *